US007832419B2

(12) United States Patent
Mason et al.

(10) Patent No.: US 7,832,419 B2
(45) Date of Patent: Nov. 16, 2010

(54) EXTRA WIDTH DISHWASHER

(75) Inventors: Wayne Andrew Mason, Dunedin (NZ); Robert William Todd, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 666 days.

(21) Appl. No.: 11/673,745

(22) Filed: Feb. 12, 2007

(65) Prior Publication Data

US 2007/0186964 A1 Aug. 16, 2007

Related U.S. Application Data

(60) Provisional application No. 60/772,596, filed on Feb. 10, 2006.

(51) Int. Cl.
*B08B 3/12* (2006.01)
*B08B 6/00* (2006.01)
*B08B 3/00* (2006.01)

(52) U.S. Cl. ..... 134/179; 134/56 D; 134/57 D; 134/58 D; 134/176

(58) Field of Classification Search ..... 134/56 D, 134/57 D, 58 D, 176, 179
See application file for complete search history.

(56) References Cited

U.S. PATENT DOCUMENTS

| | | | | |
|---|---|---|---|---|
| 2,960,990 | A | 11/1960 | Jones et al. | |
| 5,470,142 | A | 11/1995 | Sargeant et al. | |
| 5,651,382 | A * | 7/1997 | Sargeant et al. | 134/174 |
| 5,924,432 | A * | 7/1999 | Thies et al. | 134/56 D |
| 6,189,551 | B1 | 2/2001 | Sargeant et al. | |
| 6,571,808 | B2 | 6/2003 | Todd | |
| 2004/0085006 | A1 * | 5/2004 | Shinchi et al. | 312/228 |
| 2005/0211278 | A1 * | 9/2005 | Favaro et al. | 134/56 D |

FOREIGN PATENT DOCUMENTS

| | | | |
|---|---|---|---|
| JP | 63-154150 | | 6/1988 |
| JP | 2000107116 | | 10/1998 |
| JP | 2000107116 | A * | 4/2000 |
| JP | 2005110733 | A * | 4/2005 |
| WO | 00/72741 | | 12/2000 |
| WO | 01/26532 | | 4/2001 |

OTHER PUBLICATIONS

Search Report Issued by the United Kingdom Intellectual Porperty Office for GB Application No. 0702701.4; Dated Apr. 3, 2007; One (1) Page.

* cited by examiner

*Primary Examiner*—Michael Barr
*Assistant Examiner*—Charles W Kling
(74) *Attorney, Agent, or Firm*—Clark Hill PC

(57) ABSTRACT

A dishwasher includes a cabinet and a wash system slidably mounted within the cabinet in such a manner that it may be withdrawn horizontally out of the cabinet for loading with dishes. The wash system includes an open top wash chamber having a floor and side walls adapted to accommodate dishes within which wash liquid is sprayed. Two rotating spray arms are mounted in the bottom of the chamber for producing a spray of wash liquid within the chamber. A wash pump for pressurizing wash liquid discharges into a manifold located on the floor of the chamber. The spray arms receive wash liquid from the manifold. A drain pump evacuates wash liquid from said chamber. A wash chamber closure is mounted in the top of the cabinet. The closure engages with the wash chamber opening to sealably close off the wash chamber on its retraction into the cabinet.

15 Claims, 5 Drawing Sheets

EXTRA WIDTH DISHWASHER

PRIORITY

This application claims priority from U.S. Provisional Patent Application Ser. No. 60/772,596, filed Feb. 10, 2006, the disclosure of which is incorporated herein by reference.

FIELD OF INVENTION

This invention relates to dishwashers and in particular to a "drawer" type dishwasher having an increased width and volume wash tub.

PRIOR ART

Dishwashers having wash enclosures with reduced height but increased width and employing two horizontally displaced spray arms have been disclosed in U.S. Pat. No. 2,960,990; JP 63/154150 and US 2005/0211278. A dishwasher having an increased width wash enclosure while retaining conventional enclosure height which incorporates horizontally spaced apart spray arms is disclosed in WO 00/72741.

U.S. Pat. No. 5,470,142 discloses two forms of dishwasher incorporating "drawer" style wash enclosures, that is wash tubs which slide out for loading. In each case the wash tub is approximately half conventional height. In one case a single half height drawer is provided and in the other case two half height drawers are stacked in a cabinet one above the other. It would be desirable to provide a drawer style dishwasher of the type having a single drawer but with the wash tub having conventional volume. To achieve such a volume with a reduced height wash tub means the wash tub must be of increased width. Once the width of the wash tub considerably exceeds the front to back dimension more than one horizontally spaced apart wash arm must be used to ensure the entire wash tub volume receives pressurized wash water.

SUMMARY OF THE INVENTION

It is an object of the present invention to provide a drawer-style dishwasher having a single wash tub of increased width.

The invention consists in a dishwasher comprising:

(a) a cabinet, (b) a wash system slidably mounted within said cabinet in such a manner that it may be withdrawn horizontally out of said cabinet for loading with dishes, said wash system including:

(i) an open top wash chamber having a floor and side walls and adapted to accommodate dishes within which wash liquid is sprayed, the width of said wash chamber perpendicular to the direction of sliding greater than the depth of said chamber in the direction of sliding.

(ii) two rotating spray arms mounted in the bottom of said chamber for producing a spray of wash liquid within said chamber, (iii) a wash pump for pressurising said wash liquid which discharges into a manifold located on the floor of said chamber, (iv) said spray arms receiving wash liquid from said manifold, (v) means for evacuating wash liquid from said chamber, and (c) a wash chamber closure mounted in the top of said cabinet which closure is engaged with the wash chamber opening to sealably close off said wash chamber on its retraction into said cabinet.

According to a further aspect of the present invention said wash pump is a centrifugal pump including an impeller within a housing and said housing is located inside said chamber.

According to a further aspect of the present invention said pump housing is located within said manifold.

According to a further aspect of the present invention said housing has two outlets which discharge into opposing sections of said manifold.

According to a further aspect of the present invention said pump is driven by an electric motor, wherein said motor has a rotor which is mounted in a casing located below the level of the floor of said chamber, and said motor has a stator which co-acts with said rotor and is mounted exteriorly of said casing such that the stator is separated from said rotor by said casing.

According to a further aspect of the present invention said casing is joined integrally with and in the floor of said chamber.

According to a further aspect of the present invention said pump housing is located over said casing and said impeller is mounted on the drive shaft of said rotor.

According to a further aspect of the present invention said means for evacuating wash liquid from said chamber is a centrifugal drain pump formed by a second impeller connected to said rotor drive shaft within said casing co-axial with said wash pump and activated by rotating said rotor in the opposite direction to that which causes said wash pump to be effective.

According to a further aspect of the present invention the dishwasher includes a sub-chamber in the bottom of said wash chamber, an annular intake wash liquid to pass into said sub-chamber, said wash pump has an annular inlet in communication with said sub-chamber through which wash liquid is inducted from said sub-chamber in a substantially radial flowpath from said annular intake to said annular inlet, and a heating element is mounted in said sub-chamber within the radial flow path to heat wash liquid passing over it.

According to a further aspect of the present invention a first spray arm is mounted on said manifold and supplied with wash liquid directly from said manifold, and a second spray arm is mounted on the floor of said chamber remote from said manifold and supplied with wash liquid from said manifold through a conduit which passes under said wash chamber floor.

According to a further aspect of the present invention said spray arms rotate in parallel but vertically displaced planes which are parallel to the floor of said chamber.

According to a further aspect of the present invention said second spray arm rotates in a plane displaced below that plane in which said first spray arm rotates.

According to a further aspect of the present invention the width of said chamber perpendicular to the direction of sliding is greater than the depth of said chamber in the direction of sliding and said spray arms are mounted on a common axis perpendicular to the direction of sliding.

According to a further aspect of the present invention said spray arms are mounted in positions such that the areas swept by each spray arm overlap.

According to a further aspect of the present invention said conduit enters the floor of said wash chamber at a location outside the sweep of said second spray arm.

According to a further aspect of the present invention said means for evacuating wash liquid from said wash chamber includes a sump formed in the floor of said wash chamber, and an annular channel passing at least substantially around said manifold, said channel falling to said sump, and said conduit enters said floor at a location inside the path of said annular channel.

According to a further aspect of the present invention said sub-chamber is formed between said floor of said wash chamber and a cover plate, said annular inlet being a space between the edge of said cover plate and the floor of the wash chamber.

According to a further aspect of the present invention the dishwasher includes a filter plate enclosing the lower portion of said wash tub, said spray arms being above said filter plate and the remainder of said wash system being below said filter plate.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

In this patent specification the terms "wash tub" and "wash chamber" are used interchangeably.

"Cabinet" as used in this document means a supporting structure for holding supporting or containing the operative parts of the dishwasher. "Cabinet" includes structures having substantially continuous enclosing panels, open frame structures and structures, such as kitchen cabinetry, within which an appliance may be installed for use.

DESCRIPTION OF THE PREFERRED EMBODIMENTS OF THE INVENTION

Figure 1:
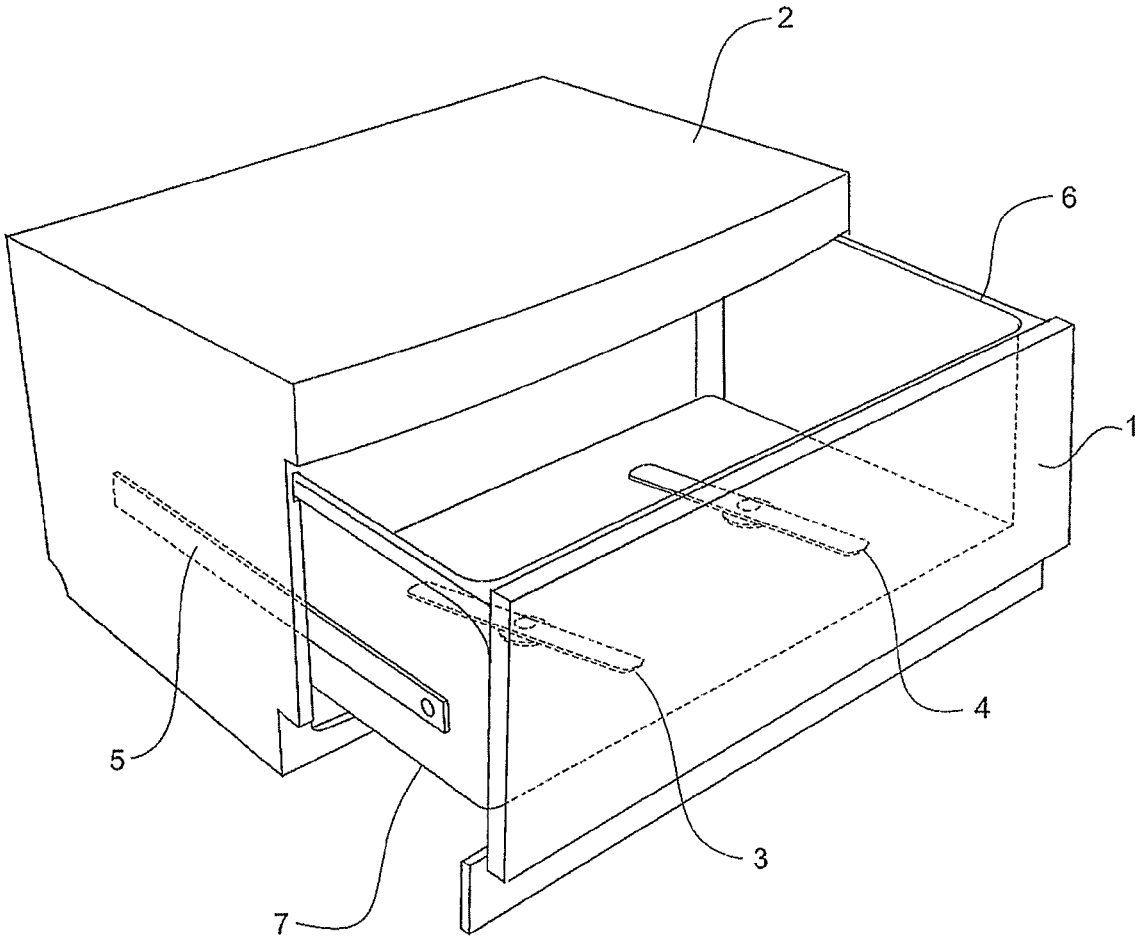
FIG. 1 is a diagrammatic pictorial view showing the double spray arm drawer type dishwasher according to the present invention.

The general configuration of the dishwasher of the present invention is shown in FIG. 1 where a wash tub 1 slides in and out of a cabinet 2 in a manner of a drawer using the concept disclosed in applicant's U.S. Pat. No. 5,470,142. In the present invention the width of the wash tub is typically 900 mm, the front to back dimension is typically 500 mm and the wash tub depth is typically 500 mm. The horizontal cross-section of the wash tub is therefore rectangular rather than square or nearly square as is usual in conventional dishwashers. It is not possible to ensure proper cleaning of dishes in a rectangular wash tub using a single central spray arm or pair of vertically co-axial spray arms. Instead two horizontally spaced apart spray arms 3 and 4 are used and in the preferred embodiment the circular areas traced out by the rotating spray arms overlap. In order to permit this without collision, spray arms 3 and 4 rotate at slightly different heights as will be explained later.

Wash tub 1 may be fabricated using injection moulded plastics or stainless steel or a combination of both. For example the tub may have stainless steel sides and a plastics injected moulded floor. Alternatively the tub may be predominantly stainless steel with the portion of the floor including the rotor housing being formed by injection moulded plastics.

The wash tub 1 is supported on slides 5 within cabinet 2 to allow sliding in and out of the cabinet for loading. Slides 5 may be of any conventional type. A lid (not shown) seals down against the rim 6 of the open topped wash tub when the tub is slid fully closed for washing operations. The lid arrangements may be as described in U.S. Pat. No. 5,470,142. A number of other arrangements for performing the lid closure are disclosed in applicant's U.S. Pat. Nos. 6,571,808 and 6,189,551. The contents of these patents is hereby incorporated by reference.

The dishwasher of the present invention is for mounting immediately under a benchtop which means the height above floor level of tub rim 6 will be in the order of 850 to 950 mm. In a preferred form the floor of the wash tub will be around 350 mm above floor level making the dishwasher easy to load and unload.

The depth of the wash tub is designed to accommodate on edge the largest diameter plates normally in use in domestic and commercial environments. Although such plates would occupy the entire vertical height of the wash tub the loss of headroom for an upper layer of utensils to be washed is compensated by the 50% "over width" wash tub.

A manifold 11 supplies pressurized wash liquid to the spray arms 3 and 4.

Referring to FIGS. 3 to 6, the dishwasher wash pump is of the centrifugal type with an impeller 9 rotating within a housing 10 included in manifold 11. The housing 10 has two outlets which each respectively supply pressurized water to spray arms 3 and 4. Preferably these outlets are diametrically opposite each other. Each outlet leads into a separate chamber of said manifold.

Alternatively the pump could be outside the manifold, for example supplying the manifold through any suitable conduit or flow path. The manifold is provided with a spigot 12 on which spray arm 3 is rotatably mounted. Pressurized water passes through spigot 12 into the interior of spray arm 3. Spigot 12 leads off one outlet chamber of the manifold. The configuration of the jets in each spray arm (for example jets 50 in spray arm 3) is such as to cause rotation of the spray arm when pressurized with water.

Manifold 11 includes an integrally formed duct 13 which forms the first section of the water path between pump 9 and spray arm 4. Duct 13 leads of the other outlet chamber of the manifold. Duct 13 extends laterally from manifold 11 above floor 7 of the dishwasher. It engages with a spigot 14 through which water passes through floor 7 to the underside where it discharges into duct 15 which provides a water path between spigot 14 and a floor spigot 16 about which spray arm 4 rotates.

It will be appreciated that spray arm 4 must rotate in a plane either above or below that of spray arm 3. For a given overall machine height, load volume and height is maximized by having spray arm 4 rotate in a plane below that of spray arm 3. Spray arm 3 is elevated due to the presence of the pump casing. To facilitate this spray arm 4 rotates in a plane as close to floor 7 as possible. To permit this the water duct 15 is located under the wash tub floor where it passes under spray arm 4. Duct 13 extends above the wash tub floor between manifold 11 and spigot 14. Duct 13 thereby traverses the annular intake plenum for the wash pump with obstructing it. In this region duct 13 is outside the region swept by spray arm 4.

Figure 5:
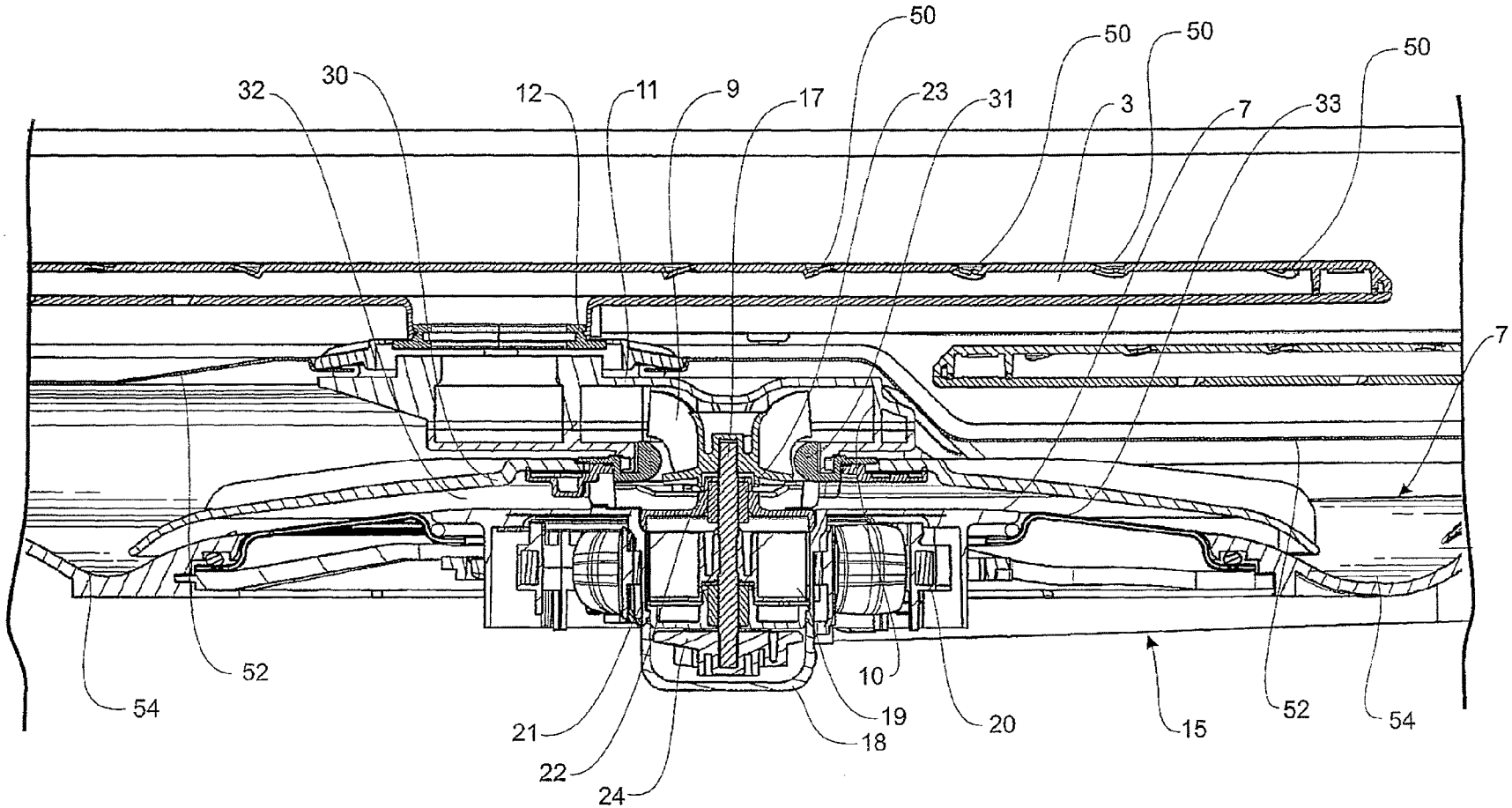
FIG. 5 shows an enlarged view of the first spray arm, wash pump, motor and manifold.
Figure 6:
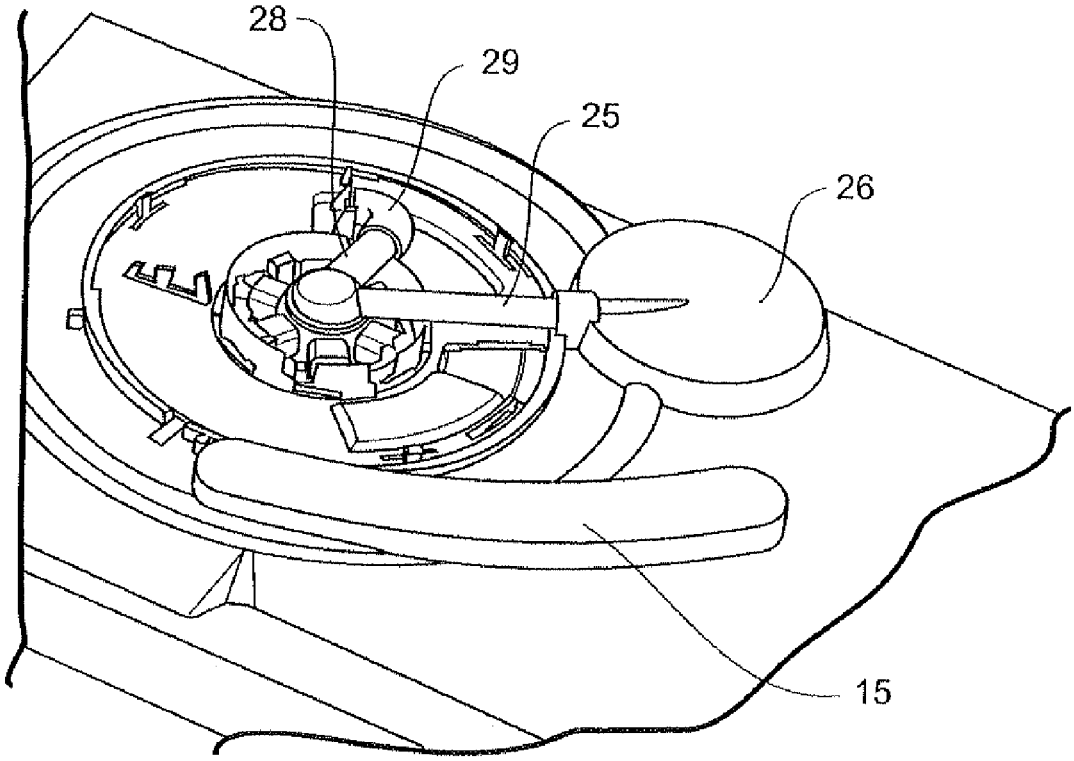
FIG. 6 shows a partial underside view of the wash tub.

The dishwasher wash pump which is best seen in FIG. 5, is driven by an electric motor through a drive shaft 17. Since the wash pump casing 10 is above the level of the wash tub floor and thus within the wash tub the drive motor is preferably contained within the wash tub to avoid the need for a dynamic water seal for the drive shaft which would be required if the motor was outside the tub. To achieve this a cavity or recess 18 is formed or fitted within the tub floor within which the motor rotor 19 rotates. In the preferred form the rotor is of the permanent magnet type. The coating stator 20 which is energized to provide a rotating magnetic flux is annular in shape and is located coaxially with rotor 19 but exterior to the vertical cylindrical wall or housing 21 of cavity 18. Typically a two, four, or six pole electronically commutated stator would be used. The cylindrical wall or housing 21 effectively lies within the motor air gap. The stator flux needs to be increased to compensate for the necessarily larger airgap.

In this configuration pump leak paths are eliminated because the pump is wholly located within the wash tub and dynamic shaft seals for the driving motor may be avoided. The motor rotor can run "wet", but while wash liquid may enter the rotor cavity, a cap 22 (which provides a support for upper shaft bearing 23) keeps debris and other abrasive substances from entering the rotor cavity. This arrangement is preferred, but not essential. The pump motor could be located outside the tub with a dynamic shaft seal preventing egress of water, or the pump could be located outside the tub with a conduit to take wash water to the manifold 11. However this embodiment would be least preferred.

The dishwasher includes means for evacuating wash liquid from the wash tub. Typically this includes one or more pumps to pump away collected water to a waste outlet.

The preferred drain pump is formed integrally with the wash pump. The drain pump is also of the centrifugal type and is formed by an impeller 24 mounted on the rotor driveshaft 17 on the opposite side of the rotor to the wash pump. Impeller 24 rotates in the bottom portion of recess 18 which forms the drain pump casing. The drain pump impeller is configured to be operative when the rotor rotates in the opposite direction to that which causes the wash pump to be operative. Thus wash pump and drain pump functions are determined simply by the direction of rotation of the electric motor.

Figure 2:
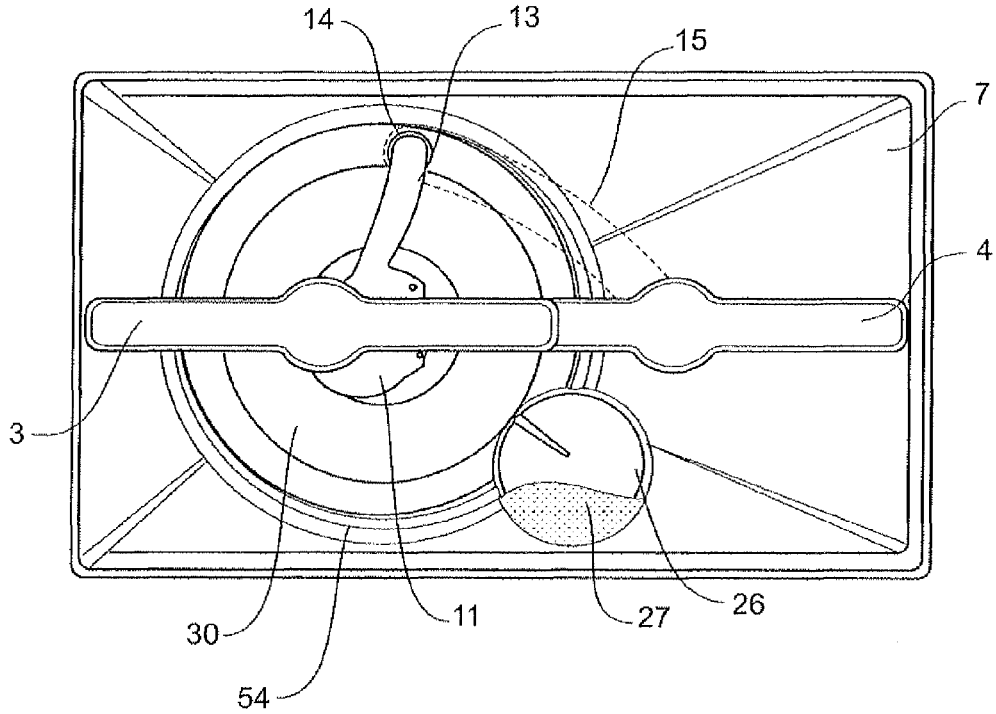
FIG. 2 shows a top view looking into the interior of the wash tub of the present invention with the filter plate removed.
Figure 3:
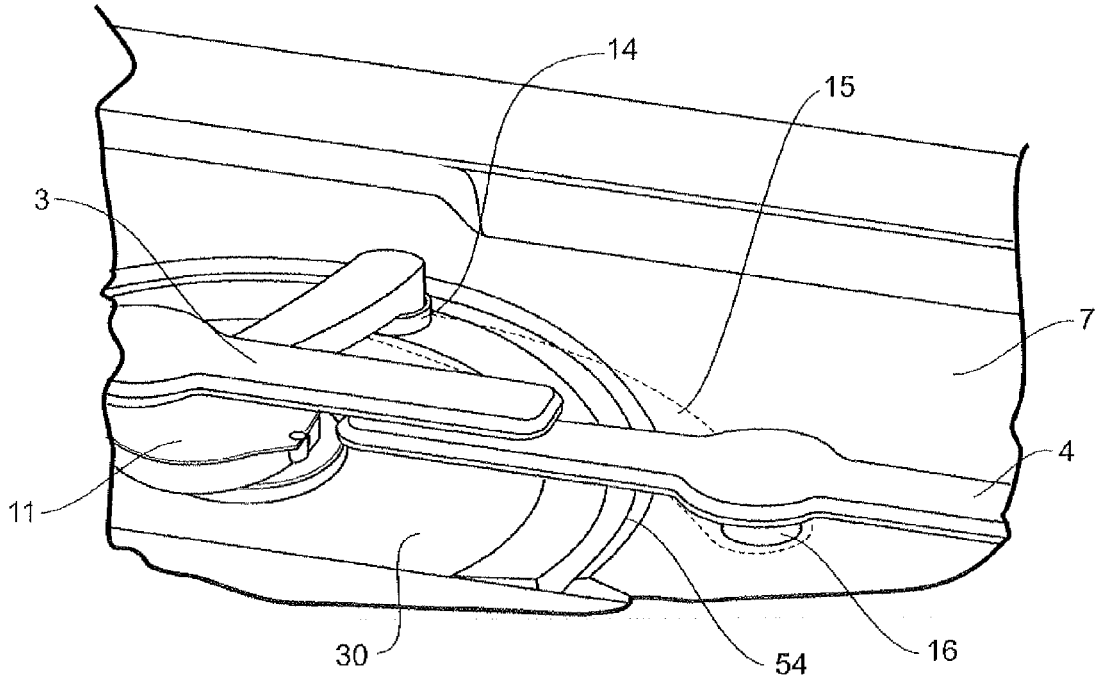
FIG. 3 is a partial oblique view of the componentry mounted in the floor of the wash tub with the filter plate removed.

A drain pump inlet tube 25 (see FIG. 6) connects into the bottom end of the drain pump casing and is led from a drain sump 26 formed in the wash tub floor. An annular channel 54 formed in the tub floor passes around the wash system and feeds sump 26. Sump 26 is provided with a perforated cover 27 (shown cutaway in FIG. 2) which forms a drain sump filter. The outlet tube 28 of the drain pump connects to a flexible drain hose (not shown) through coupling 29.

The means for evacuating wash liquid from the chamber may alternatively comprise one or more independent drain pumps. The independent drain pump or pump may be supplied with drain water from one or more sumps in said chamber floor. The pumps may be integrated to the floor or be supplied via drainage conduits or hoses.

Figure 4:
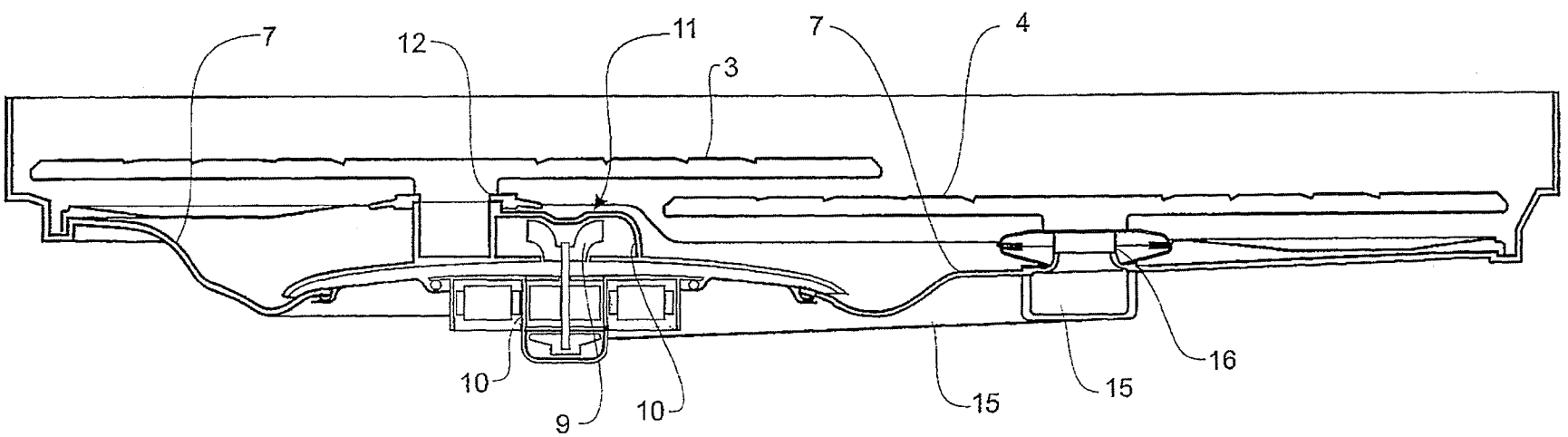
FIG. 4 shows a cross-sectional side elevation of the wash tub floor, and wash system including two spray arms.

Referring to FIGS. 4 and 5 a filter plate 52 extends across the wash tub just below the level of spray arms 3 and 4. The filter plate includes perforations to allow wash water to drain through to the floor of the wash tub. The filter plate covers the wash system and is contoured to avoid contacting the rotating wash arms. The supply spigot for each wash arm passes through a corresponding aperture in the filter plate. The plate is preferably supported at its periphery by the wash tub and at the supply spigot for each wash arm.

A plate 30 is provided just above the bottom of the wash tub floor 7 to form a sub-chamber 32 through which wash water flows radially to be induced into wash pump 9 through an inlet 31. Plate 30 in one form may be shaped so that the periphery of the plate meets the wash tub floor. In that case a series of circumferential perforations or apertures remote from the centre allow wash water to pass into sub-chamber 32 for induction into the wash pump. However preferably the plate 30 is solid and instead has an outer edge spaced away from the floor of the wash tub to form an annular intake for sub-chamber 32. Wash pump 9 is thereby provided with an effective large area but low head inlet corresponding to the circumference of the plate 30 at the radius of the intake multiplied by the height of the sub-chamber 32 at that circumference.

Wash water is heated by a heating element which heats the water in sub-chamber 32. In the preferred form this is provided by an annular plate 33 made of a suitable metal with thick film resistive tracks deposited on the underside thereof. The top surface of plate 33 heated by the resistive tracks dissipates heat into the water passing through sub-chamber 32. A less preferable form of water heating could be provided using a conventional tubular heating element disposed within sub-chamber 32 so as to uniformly heat water passing through that chamber.

What we claim is:

1. A dishwasher comprising:

(a) a cabinet, (b) a wash system slidably mounted within said cabinet in such a manner that it may be withdrawn horizontally out of said cabinet for loading with dishes, said wash system including:

an open top wash chamber having a floor and side walls and adapted to accommodate dishes within which wash liquid is sprayed, the width of said open top wash chamber perpendicular to the direction of sliding being greater than the depth of said wash chamber in the direction of sliding, (ii) a first rotating spray arm and a second rotating spray arm mounted in the bottom of said wash chamber for producing a spray of wash liquid within said wash chamber, (iii) a manifold located on the floor of said wash chamber, (iv) a wash pump for pressurising said wash liquid which discharges into said manifold, (v) said spray arms receiving wash liquid from said manifold, said first spray arm being mounted on said manifold and supplied with wash liquid directly from said manifold, and said second spray arm being mounted below the first spray arm on said floor and remote from said manifold, said second spray arm supplied with wash liquid from said manifold through first and second ducts, said first duct positioned above the floor of said wash chamber at a location outside a region swept by the second spray arm, and said second duct passing under said floor and said second spray arm, (v) means for evacuating wash liquid from said chamber, and (c) a wash chamber closure mounted in the top of said cabinet which closure is engaged with the wash chamber opening to sealably close off said wash chamber on its retraction into said cabinet.

2. A dishwasher according to claim 1 wherein said wash pump is a centrifugal pump including an impeller within a housing and said housing is located inside said chamber.

3. A dishwasher according to claim 2 wherein said pump housing is located within said manifold.

4. A dishwasher according to claim 3 wherein said housing has two outlets which discharge into opposing sections of said manifold.

5. A dishwasher according to claim 2 wherein said pump is driven by an electric motor, wherein said motor has a rotor which is mounted in a casing located below the level of the floor of said chamber, and said motor has a stator which co-acts with said rotor and is mounted exteriorly of said casing such that the stator is separated from said rotor by said casing.

6. A dishwasher according to claim 5 wherein said casing is joined integrally with and in the floor of said chamber.

7. A dishwasher according to claim 5 wherein said pump housing is located over said casing and said impeller is mounted on the drive shaft of said rotor.

8. A dishwasher according to claim 5 wherein said means for evacuating wash liquid from said chamber is a centrifugal drain pump formed by a second impeller connected to said rotor drive shaft within said casing co-axial with said wash pump and activated by rotating said rotor in the opposite direction to that which causes said wash pump to be effective.

9. A dishwasher according to claim 2 including a sub-chamber in the bottom of said wash chamber, an annular intake for intake wash liquid to pass into said sub-chamber, said wash pump has an annular inlet in communication with said sub-chamber through which wash liquid is inducted from said sub-chamber in a substantially radial flowpath from said annular intake to said annular inlet, and a heating element is mounted in said sub-chamber within the radial flow path to heat wash liquid passing over it.

10. A dishwasher according to any one of claims 1 to 9 wherein said spray arms rotate in parallel but vertically displaced planes which are parallel to the floor of said chamber.

11. A dishwasher as claimed in claim 9 wherein said sub-chamber is formed between said floor of said wash chamber and a cover plate, said annular inlet being a space between the edge of said cover plate and the floor of the wash chamber.

12. A dishwasher according to claim 1 wherein said spray arms are mounted on a common axis perpendicular to the direction of sliding.

13. A dishwasher according to claim 1 wherein said spray arms are mounted in positions such that the areas swept by each spray arm overlap.

14. A dishwasher as claimed in claim 1 wherein said means for evacuating wash liquid from said wash chamber includes a sump formed in the floor of said wash chamber, and an annular channel passing at least substantially around said manifold, said channel falling to said sump, and said first and second ducts enter said floor at a location inside the path of said annular channel.

15. A dishwasher as claimed in claim 1 including a filter plate enclosing the lower portion of said wash tub, said spray arms being above said filter plate and the remainder of said wash system being below said filter plate.

* * * * *